US009003974B2

(12) United States Patent
Muskat et al.

(10) Patent No.: US 9,003,974 B2
(45) Date of Patent: Apr. 14, 2015

(54) HOLLOW-CHANNEL PROJECTILE NOSE AND SHAPING OF A PROJECTILE BODY IN THE NOSE REGION

(75) Inventors: Erich Muskat, Roth (DE); Heinz Rieβ, Fürth (DE)

(73) Assignee: Ruag Ammotec GmbH, Furth (DE)

( * ) Notice: Subject to any disclaimer, the term of this patent is extended or adjusted under 35 U.S.C. 154(b) by 0 days.

(21) Appl. No.: 14/237,634

(22) PCT Filed: Aug. 7, 2012

(86) PCT No.: PCT/EP2012/065434

§ 371 (c)(1),
(2), (4) Date: Feb. 7, 2014

(87) PCT Pub. No.: WO2013/020975

PCT Pub. Date: Feb. 14, 2013

(65) Prior Publication Data

US 2014/0202351 A1 Jul. 24, 2014

(30) Foreign Application Priority Data

Aug. 8, 2011 (DE) ..... 10 2011 109 671

(51) Int. Cl.
*F42B 12/34* (2006.01)
*F42B 12/02* (2006.01)
*F42B 12/74* (2006.01)

(52) U.S. Cl.
CPC ..... *F42B 12/02* (2013.01); *F42B 12/34* (2013.01); *F42B 12/74* (2013.01); *F42B 12/745* (2013.01)

(58) Field of Classification Search
CPC ..... F42B 12/00; F42B 12/02; F42B 12/34; F42B 12/72; F42B 12/76; F42B 12/78; F42B 12/745; F42B 12/74
USPC ..... 102/501, 503, 507–510, 514, 516, 517, 102/473
See application file for complete search history.

(56) References Cited

U.S. PATENT DOCUMENTS 1,023,469 A * 4/1912 Haslett ..... 102/510
2,324,551 A * 7/1943 Albree ..... 244/3.1

(Continued)

FOREIGN PATENT DOCUMENTS

DE 20 2005 013 495 U1 11/2006
EP 100 10 500 A1 9/2001
EP 2 226 606 A2 9/2010

OTHER PUBLICATIONS

International Search Report mailed Nov. 2, 2012, in connection with International Application No. PCT/EP2012/065434, 2 pages.

*Primary Examiner* — Jonathan C Weber
(74) *Attorney, Agent, or Firm* — Antonelli, Terry, Stout & Kraus, LLP.

(57) ABSTRACT

The invention relates to a projectile having a cylindrical hole (15) arranged at the nose as seen in the firing direction, said hole (15) extending coaxially with the longitudinal axis (12) of the projectile and a projectile nose (1) being inserted into this hole, wherein the longitudinal axis (12) of the projectile at the same time also forms the longitudinal axis of the projectile nose (1). In order that accelerated expansion of the projectile occurs when the projectile strikes a soft medium, it is proposed according to the invention that an open hollow channel (5) is introduced in the projectile nose (1) coaxially with the longitudinal axis (12), said hollow channel (5) extending from the front end (22) to the rear end (23) of the projectile nose (1), as seen in the firing direction, and a membrane (6) is arranged in the hollow channel (5), said membrane dividing the hollow channel (5) into two hollow-channel portions (5*a*, 5*b*).

19 Claims, 3 Drawing Sheets

(56) References Cited

U.S. PATENT DOCUMENTS

Figure 1:
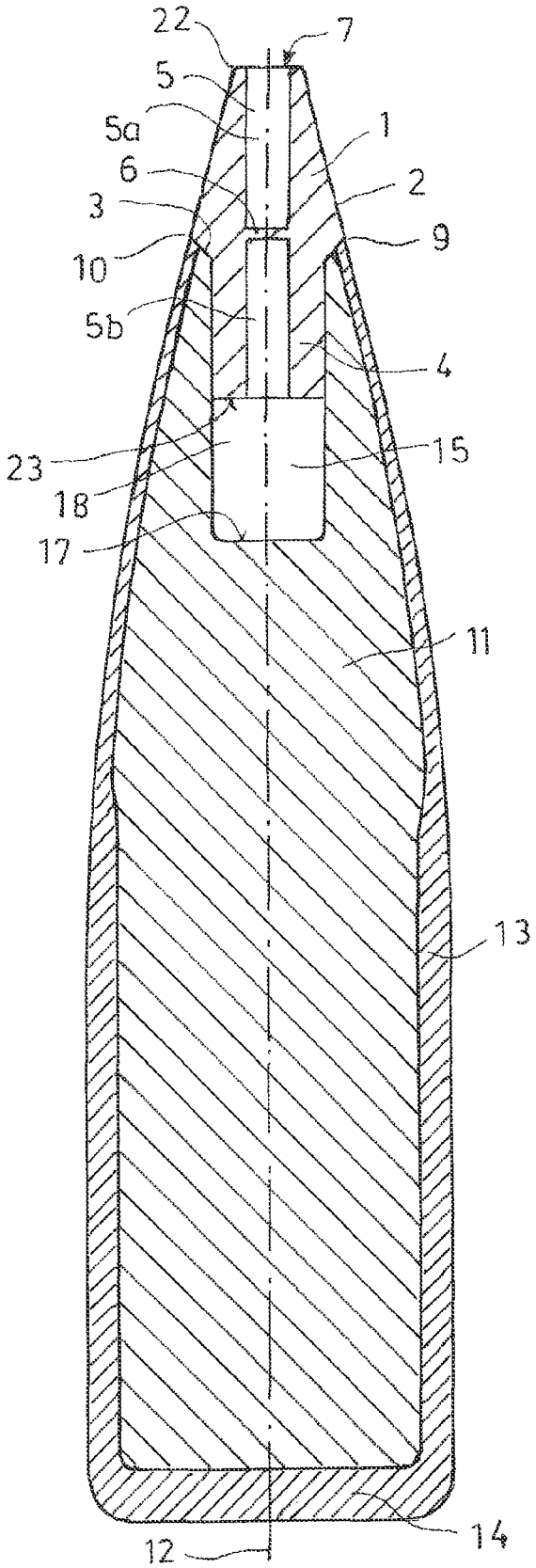

| | | | | | |
|---|---|---|---|---|---|
| 4,136,616 | A | * | 1/1979 | Schirneker | 102/510 |
| 4,175,492 | A | * | 11/1979 | Knappworst et al. | 102/503 |
| 4,485,742 | A | * | 12/1984 | Mamo | 102/430 |
| 4,964,341 | A | * | 10/1990 | Hebert | 102/501 |
| 6,971,315 | B2 | * | 12/2005 | Knappworst et al. | 102/510 |
| 7,171,905 | B2 | * | 2/2007 | Hirt et al. | 102/509 |
| 2004/0025737 | A1 | | 2/2004 | Knappworst et al. | |
| 2010/0224093 | A1 | | 9/2010 | Wilhelm et al. | |

* cited by examiner

HOLLOW-CHANNEL PROJECTILE NOSE AND SHAPING OF A PROJECTILE BODY IN THE NOSE REGION

The invention relates to a projectile having a cylindrical bore arranged at the tip as seen in the firing direction, this bore running coaxially with the longitudinal axis of the projectile, and a projectile tip being inserted into this bore, wherein the longitudinal axis of the projectile at the same time also forms the longitudinal axis of the projectile tip.

Such a projectile is described in EP 1 502 074 B1.

The object of the present invention is to improve upon a projectile according to the preamble of claim 1 such that when the projectile strikes a soft medium, there is accelerated expansion of the projectile, and at the same time, foreign bodies and moisture are prevented from penetrating into the projectile body.

This object is achieved by a projectile having the features of claim 1.

Due to the fact that an open hollow channel is formed coaxially with the longitudinal axis in the projectile tip, extending from the forward end to the rear end of the projectile tip, as seen in the direction of firing, and a membrane is arranged in the hollow channel, dividing the hollow into two hollow channel sections, there is accelerated expansion of the projectile when the projectile strikes a soft medium, and at the same time penetration of foreign bodies and moisture into the projectile body is prevented.

The hollow channel ensures that when the projectile encounters a soft medium, it will penetrate into the projectile tip. Then the membrane is broken open and the soft medium migrates to the bottom of the projectile tip. This results in accelerated expansion of the projectile. The hollow channel diameter will depend on the caliber. It is preferably between 0.2 mm and 6 mm. The membrane prevents the penetration of moisture and foreign bodies into the hollow channel section of the projectile tip situated beneath the membrane when the cartridge is in storage.

The two hollow channel sections are preferably essentially of the same length.

In a preferred embodiment, the front region of the projectile tip has a conical shape with an angle β, such that the diameter is the smallest at the front end of the projectile tip, and the rear end of the projectile tip is designed as a holding cylinder. The holding cylinder has a diameter adapted to the cylindrical bore in the projectile.

In one embodiment, the conical front region develops into the holding cylinder by way of an bevel with an expansion angle α on its end facing the holding cylinder, such that the expansion angle α is measured clockwise from the longitudinal axis. The expansion angle α is preferably between 10° and 80°. When the projectile tip encounters a medium, the projectile tip is displaced with its bevel into the cylindrical bore at the tip of the projectile and thus exposes the projectile body and optionally the projectile jacket, which thus forms an annular surface. This initiates early disintegration of the projectile. In the case of a non-disintegrable projectile, the exposed annular surface does not function as an expansion aid but rather as a sharp edge which punches a bore out of the medium in passing through it.

To improve this displacement and/or slippage, the bevel at the projectile tip preferably lies flatly on the corresponding surfaces of the projectile body and on the projectile jacket in the case of jacketed projectiles.

The front end of the projectile tip is preferably provided with a flat surface.

The projectile tip may be made of the following materials: plastics, polymer plastics with or without additives, where the additives may be glass fibers, metal powders or powders of metal compounds such as $BaSO_4$ or colored pigments, for example.

The projectile tip may also be made of the following materials: completely made of metal or metal alloys, for example, aluminum produced by the die-casting method.

A clearance is provided between the rear end of the projectile tip and the bottom of the cylindrical bore. This clearance serves to receive the penetrating soft medium and to improve the expansion of the projectile on impact.

The projectile is preferably a jacketed projectile or a non-disintegrable projectile.

The invention is explained further on the basis of three figures.

Figure 2:
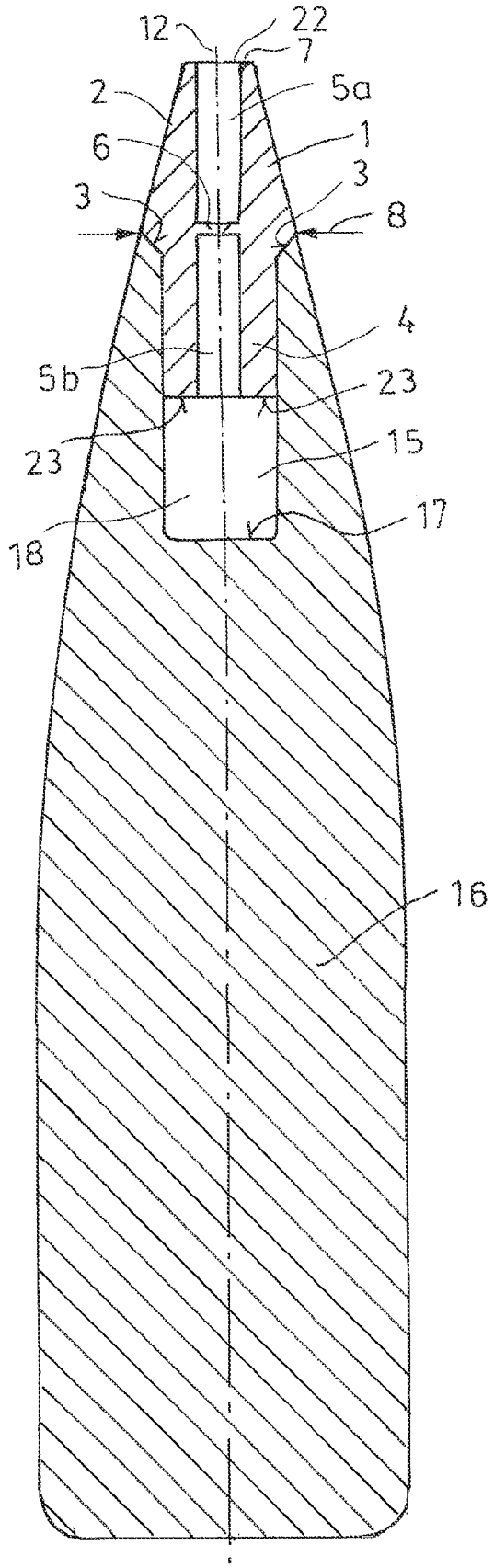
Figure 3:
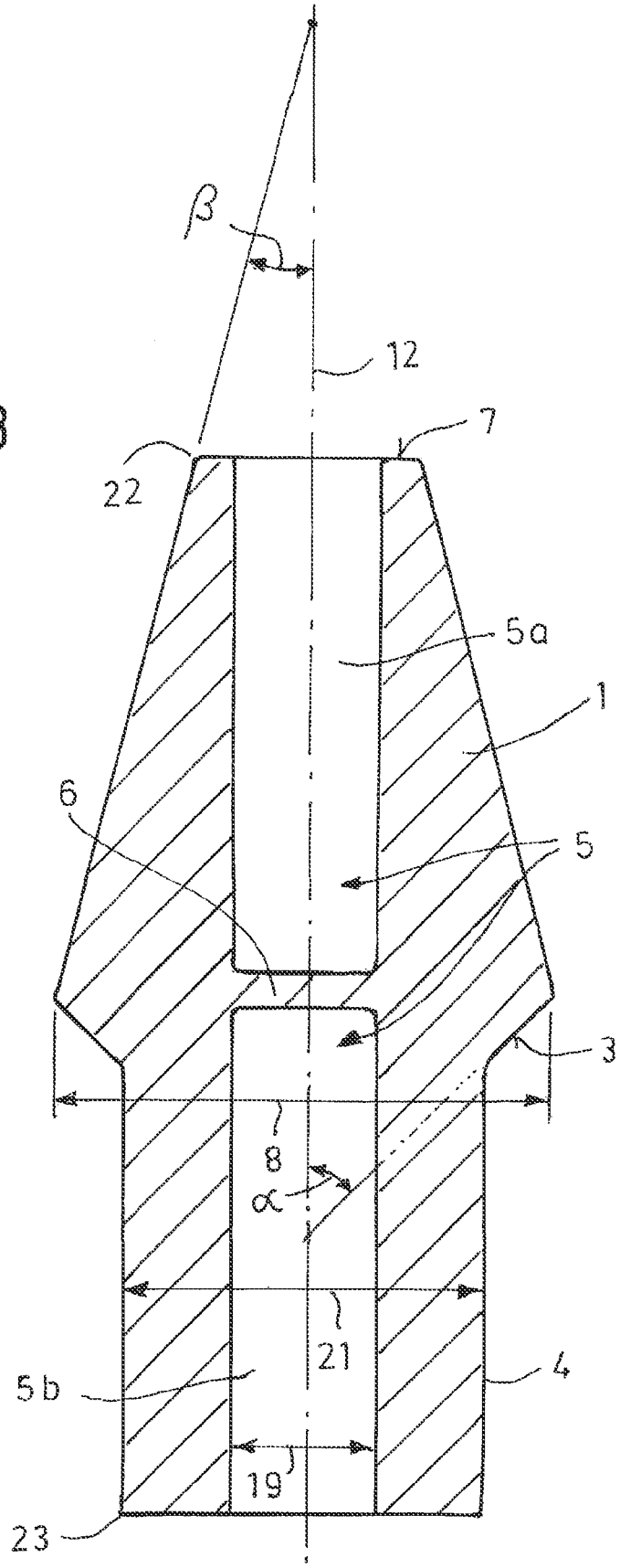

FIG. 3 shows a projectile tip 1 according to the invention, preferably for a jacketed projectile according to FIG. 1 or a non-disintegrable projectile 16 according to FIG. 2.

The materials of which the projectile tip 1 is made are preferably as follows: plastics, polymer plastics with or without additives. The additives may include glass fibers, metal powders or powders of metal compounds such as $BaSO_4$, colored pigments. In addition the projectile tip may be made completely of metal or metal alloys, for example, aluminum, manufactured by the die-casting method.

The projectile tip 1 has a conical front region 2 which extends from the front flat surface 7 to the maximum diameter 8 of the projectile tip 1. The conical front region 2 then develops into the holding cylinder 4 by way of a bevel 3. A hollow channel 5 which runs coaxially with the longitudinal axis 12 is formed in the projectile tip 1. A membrane 6 which divides the hollow channel 5 into two hollow channels 5*a*, 5*b* of essentially the same length is arranged at the center, i.e., in the region of the maximum diameter 8.

The expansion angle α of the bevels 3 (a is measured clockwise from the longitudinal axis 12) is not 90°, in contrast with the usual projectile tips made of plastics, but instead is preferably between 10° and 80°. The bevel 3 of the projectile tip 1 lies flatly on the corresponding surfaces 9, 10 of the projectile body 11 and of the projectile jacket 13 (see FIG. 1). FIG. 2 shows a non-disintegrable projectile 16 where the bevel 3 lies flatly on a surface 9 of the non-disintegrable projectile 16 corresponding to the bevel 3 (see FIG. 2).

The projectile tip 1 together with its holding cylinder 4 is inserted into a bore 15 in the projectile body 11 and/or the projectile 16 and rests on the surfaces 9 and 10 described above. A clearance 18 may be provided between the inserted projectile tip 1 and the bottom 17 of the bore 15.

When the projectile tip 1 strikes a soft medium, it is displaced along the surfaces 9 or 10 into the bore 15 at the tip of the projectile body 11 and thus exposes these surfaces 9 or 10. This initiates an early disintegration of the projectile.

The central feature of the present hollow channel projectile tip is the hollow channel 5, which is interrupted by a membrane 6.

The membrane 6 prevents the penetration of foreign bodies and moisture into the projectile body, i.e., the projectile. Furthermore, on impact of the projectile with a soft medium, the hollow channel 5 ensures that the soft medium will penetrate into the projectile body tip 1, i.e., the hollow channel 5. In doing so, the membrane 6 is ruptured and the medium migrates to the bottom of the projectile tip 1. This results in an accelerated expansion of the projectile. The hollow channel diameter 19 depends on the caliber and is preferably between 0.2 mm and 6 mm. The hollow channel diameter 19 is preferably somewhat smaller than the diameter 21 of the holding cylinder 4.

The membrane 6 prevents the penetration of moisture and foreign bodies into the hollow channel section 5*b* of the projectile tip 1 below the membrane 6 during storage of the cartridge. The thickness of the membrane 6 may vary from 0.1 mm to the diameter of the bore. The hollow channel 5 and/or the hollow channel sections 5*a*, 5*b* is/are in contact with the flat surface 7 at the upper, i.e., forward end 22 and open at the rear end 23.

The flat surface 7 prevents damage to the projectile tip 1.

The projectile tip diameter 8 is the largest diameter, i.e., the maximum diameter of the projectile tip 1. It is determined according to the desired response behavior of the projectile. The diameter is between 2 mm and the caliber of the projectile.

The projectile tip 1 may be used for calibers between .22 and 12.7 mm. The type of projectile may be a disintegrating projectile, a partially disintegrating projectile, a deformation projectile or a non-disintegrating projectile 16 (see FIG. 2). The present projectile tip 1 may, however, also be used with a projectile lathed out of a solid material.

The material of the projectile core 11 of the jacketed projectile according to FIG. 1 may be made of a Pb-containing material or a Pb-free material. A mix of Pb-containing material and Pb-free material is also possible.

The projectile jacket 13 of the jacketed projectile according to FIG. 1 may be made of the materials Cu, CuZn, Steel and other metals. Furthermore, plated projectile jackets or jackets that are otherwise coated (e.g., coating with lubricating lacquer) may also be used. The jacket wall thickness may vary between 0.2 mm and 3 mm, depending on the caliber and velocity. The jacket wall thickness may also have a gradient.

Functioning:

On impact of the projectile tip 1 with a medium, the projectile tip 1 may penetrate into the deeper bore 15 (max. to the projectile 17) in the holding cylinder 4. This exposes an annular surface 9, 10, which initiates immediate expansion of the projectile due to the influx of the medium. Then the medium penetrates further through the hollow channel section 5*b* into the projectile tip 1, puncturing the membrane 6 and thus accelerating the expansion of the projectile.

The functioning described here is the same with all types of projectiles. In the case of a non-disintegrable projectile according to FIG. 2, the projectile tip diameter 8 must be selected to be larger, up to the maximum caliber diameter. The exposed annular surface does not act as an expansion aid but instead as a sharp edge which punches a bore out of the medium in passing through it.

The invention claimed is:

1. A projectile comprising a cylindrical bore arranged at the tip, as seen in the direction of firing, the bore running coaxially with a longitudinal axis of the projectile and a projectile tip is inserted into this bore, a clearance being provided between the inserted projectile tip and a bottom of the bore within the projectile, wherein the longitudinal axis of the projectile also forms the longitudinal axis of the projectile tip, characterized in that an open hollow channel is formed coaxially with the longitudinal axis in the projectile tip, extending from the front end to the rear end of the projectile tip in the direction of firing, and a membrane which divides the hollow channel into two hollow channels sections is provided in the hollow channel, wherein the projectile is configured to undergo an accelerated expansion when the projectile strikes a medium.

2. The projectile according to claim 1, characterized in that the front region of the projectile tip has a conical shape with an angle β, where the diameter at the front end is the smallest and the rear end of the projectile tip is designed as a holding cylinder and has a diameter adapted to the cylinder bore in the projectile.

3. The projectile according to claim 2, characterized in that the conical front region develops into the holding cylinder at its end facing the holding cylinder by way of a bevel with an expansion angle α wherein the expansion angle α is measured clockwise from the longitudinal axis.

4. The projectile according to claim 3, characterized in that the expansion angle α is between 10° and 80°.

5. The projectile according to claim 3, characterized in that the bevel rests flatly on the corresponding surfaces of the projectile.

6. The projectile according to claim 5, further comprising a projectile jacket, characterized in that the bevel further rests flatly on the corresponding surfaces of the projectile jacket.

7. The projectile according to claim 1, characterized in that the front end of the projectile tip is provided with a flat surface.

8. The projectile according to claim 1, characterized in that the projectile tip is made of the following materials: plastics, polymer plastics with or without additives.

9. The projectile according to claim 8, characterized in that the additives are glass fibers, metal powder or powders of metal compounds, or colored pigments.

10. The projectile according to claim 9, wherein the powders of metal compounds comprise $BaSO_4$.

11. The projectile according to claim 1, characterized in that the projectile tip is made of the following materials: completely of metal or metal alloys, and is produced by the die casting method.

12. The projectile according to claim 11, wherein the metal or metal alloys comprise aluminum.

13. The projectile according to claim 1, characterized in that the projectile is a jacketed projectile or a non-disintegrable projectile.

14. The projectile according to claim 1, wherein the medium is a soft medium.

15. A projectile assembly comprising:

a projectile, a front portion of the projectile comprising a bore, the bore being coaxial with a longitudinal axis of the projectile, the bore comprising an opening at the front portion of the projectile and a closed bottom within the projectile;

a projectile tip comprising a front end and a rear end, the rear end of the projectile tip being provided in the bore of the projectile with a clearance between the rear end of the projectile tip and the closed bottom of the bore within the projectile, the projectile tip comprising a hollow channel coaxial to the longitudinal axis of the projectile, the hollow channel comprising an opening at the front end of the projectile tip and an opening at the rear end of the projectile tip, a first portion of the hollow channel adjacent to the front end of the projectile tip being separated from a second portion of the hollow channel adjacent to the rear end of the projectile tip by a membrane.

16. The projectile assembly according to claim 15, wherein the front end of the projectile tip comprises a conical region, the rear end of the projectile tip comprises a holding cylinder, an outer diameter of the holding cylinder conforms to an inner diameter of the bore, and an outer diameter of the conical region is smallest at a front edge of the front end of the projectile tip.

17. The projectile assembly according to claim 16, wherein the projectile tip further comprises a bevel between the conical region and the holding cylinder, wherein the outer diameter of the conical region gradually increases along a section of the projectile tip from the front edge toward the bevel, and an outer diameter of the bevel gradually decreases along another section of the projectile tip from the conical region toward the holding cylinder.

18. The projectile assembly according to claim 17, wherein the bevel flatly contacts surfaces of the projectile surrounding the opening of the bore.

19. The projectile assembly according to claim 18, further comprising jacketing covering the projectile, wherein the bevel further flatly contacts surfaces of the jacketing surrounding the opening of the bore.

* * * * *